US009073067B2

(12) United States Patent
Morgan et al.

(10) Patent No.: US 9,073,067 B2
(45) Date of Patent: Jul. 7, 2015

(54) MANUALLY CONNECTED NOZZLE ASSEMBLY

(71) Applicants: Stuart Morgan, Cheltenham (AU); Sean Morgan, Cheltenham (AU)

(72) Inventors: Stuart Morgan, Cheltenham (AU); Sean Morgan, Cheltenham (AU)

( * ) Notice: Subject to any disclaimer, the term of this patent is extended or adjusted under 35 U.S.C. 154(b) by 0 days.

(21) Appl. No.: 14/087,515

(22) Filed: Nov. 22, 2013

(65) Prior Publication Data

US 2014/0145016 A1 May 29, 2014

Related U.S. Application Data

(63) Continuation-in-part of application No. 11/914,621, filed as application No. PCT/AU2006/000648 on May 16, 2006, now abandoned.

(30) Foreign Application Priority Data

May 16, 2005 (AU) ..... 2005902496

(51) Int. Cl.
*B05B 15/02* (2006.01)
*B05B 1/02* (2006.01)
*B05B 15/06* (2006.01)

(52) U.S. Cl.
CPC ..... *B05B 1/02* (2013.01); *B05B 15/0208* (2013.01); *B05B 15/065* (2013.01)

(58) Field of Classification Search
CPC ..... B05B 1/02; B05B 15/0208; B05B 15/065
USPC ..... 239/542, 546, 547, 550, 596, 600, 239/DIG. 12
See application file for complete search history.

(56) References Cited

U.S. PATENT DOCUMENTS

| | | | | |
|---|---|---|---|---|
| 2,581,289 | A * | 1/1952 | Prevost | 239/116 |
| 2,884,203 | A * | 4/1959 | Broughton | 239/116 |
| 3,228,611 | A * | 1/1966 | Russell | 239/116 |
| 3,468,265 | A | 9/1969 | Otken | |
| 4,471,913 | A * | 9/1984 | Hofmann | 239/550 |
| 4,867,870 | A * | 9/1989 | Kettlety et al. | 210/139 |
| 5,664,731 | A * | 9/1997 | Lemetyinen et al. | 239/113 |
| 5,909,847 | A * | 6/1999 | Munsche et al. | 239/116 |
| 7,182,273 | B2 * | 2/2007 | Proulx, Jr. | 239/110 |
| 7,617,990 | B2 * | 11/2009 | Huffman | 239/1 |
| 7,988,069 | B2 * | 8/2011 | Huffman et al. | 239/116 |
| 2004/0195353 | A1 | 10/2004 | Proulx | |
| 2004/0227021 | A1 | 11/2004 | Romack et al. | |

FOREIGN PATENT DOCUMENTS

GB 2274495 A 7/1994

* cited by examiner

*Primary Examiner* — Christopher Kim
(74) *Attorney, Agent, or Firm* — Edwin D. Schindler

(57) ABSTRACT

A nozzle assembly includes a base fixed to a spray pipe containing an internal brush system, a cap that can engage to the base in only one orientation by a multiple lug and receptacle combination, including at least a first lug and a second lug and a first receptacle and a second receptacle, and a nozzle disc able to be held compressively between the base and the cap with a bore extending through the spray pipe, the base and the cap. The nozzle disc includes a nipple extending into the spray pipe when the nozzle assembly is assembled, in which the multiple lug and receptacle combination has at least two circumferentially spaced male lugs or female lugs for engaging complementary receptors, so that the cap is manually able to be engaged to the base by applying axial compression to the cap and twisting the cap relative to the base until the first lug and second lug are locked in engagement in the corresponding first receptacle and second receptacle in the one orientation.

12 Claims, 4 Drawing Sheets

MANUALLY CONNECTED NOZZLE ASSEMBLY

CROSS-REFERENCE TO PRIOR APPLICATION

This is a continuation-in-part of U.S. patent application Ser. No. 11/914,621, filed Nov. 10, 2008, now abandoned, which represents the U.S. National Phase application of P.C.T. Application No. PCT/AU2006/000648, filed May 16, 2006, the entire disclosure of which shall be deemed to be incorporated by reference herein.

BACKGROUND OF THE INVENTION

1. Technical Field of the Invention

This invention relates to the area of spray nozzles for use with fluids which are contaminated with particulate matter and in particular for use where white water or process water and the like are recycled and used for spraying applications.

2. Description of the Prior Art

Traditionally in the paper industry, and other such industries, particulate contaminated fluids such as white water and process water and the like are recycled and used for spraying applications. It is therefore desirable to use a spray nozzle system which reduces the likelihood of, or prevents blocking of, the nozzle orifice by this particulate matter.

A commonly accepted nozzle system utilizes a pressed disc shaped nozzle, with a convex nipple which contains an orifice, and which protrudes up into and past the internal diameter of the spray pipe it is mounted to. By this means any particulate, or sediment, cannot readily pass into the orifice due to its higher position in the pipe.

It is also customary for the pipe to contain a longitudinal brush system that can rotate and sweep the interior of the pipe and make ready contact with the protruding orifice nipple. Thus particulate matter can be swept from a blocked nozzle by a machine operator by turning a valve type wheel at the end of the pipe or header.

Typically with such a system there is a requirement that the shower disc be mounted on a low profile mounting socket system to ensure that the thin disc nipple does in fact protrude into the pipe. However, due to the fact that the spray pattern is generated far inside the pipe at the end of the orifice nipple, in instances where a wider spray pattern is required it is necessary that this mounting socket is also of a significant diameter. The low profile and significant diameter of the mounting system ensures that the spray pattern is not fouled or disrupted.

This system must also allow for a sealing gasket to ensure that the orifice disc seals against the low profile pipe socket which is usually welded into place. The achievement of the above desired criteria for a mounting system results in significant restriction in the designs which can be used.

A universally accepted retaining socket system has traditionally been a low profile, large diameter threaded socket with an internal sealing face for a sealing washer which then receives the shower disc nipple and is secured via a male threaded screw in plug type retaining ring which typically has a broached hexagonal internal socket, significant enough in diameter to clear the spray while allowing for a tool to engage it and thereby applying significant torque to secure the shower disc and form a seal with the gasket.

These securing systems require tools in order to effect assembly and disassembly and are awkward and cumbersome to handle. Difficulties arise both in inserting the orifice disc and seal into the inverted header pipe socket. Both the disc and seal may start to fall out as the operator tries to insert the retaining plug, the latter having a fine thread pitch which makes it difficult to commence thread engagement, and at the same time hold the nozzle in the correct spraying plane position until it is finally secured.

SUMMARY OF THE INVENTION

It is an object of the invention to simplify the assembly procedure for the insertion and removal of the shower discs such that no tools are required and the shower disc can remain in the retaining cap retained by its own seal right up to the moment of actual assembly such that the nozzle is maintained in its correct spray plane and any possibility of the nozzle falling out during assembly is eliminated.

In one preferred embodiment of the invention there is provided a nozzle assembly comprising:

- a base adapted to be fixed to a spray pipe containing an internal brush system;
- a cap engageable to the base by a multiple lug and receptacle combination;
- a nozzle disc adapted to be held compressively between the base and the cap; and a bore extending through the pipe, the base and the cap, the nozzle disc comprising a nipple that extends into the pipe when the nozzle assembly is assembled, wherein the multiple lug and receptacle combination comprises at least two circumferentially spaced male or female lugs adapted to engage complementary receptors, such that the cap is manually engageable to the base by applying axial compression to the cap and twisting the cap relative to the base until the respective lugs are located in the corresponding receptacles.

In another preferred embodiment, the invention involves a nozzle system having a first component in fixed engagement with a spray pipe, said first base component being provided with means to engage manually with a second cap component such that a shower disc is held compressively between these two components, each of which is provided with a central aperture, the arrangement being such that a shower disc nipple extends into the pipe when assembled.

It is preferred that the base component be welded to the spray pipe. It may alternatively be preferred that it be retained on the pipe by means of spring clips or cable ties or other means.

It is further preferred that the base component be provided with a plurality of lugs which can engage with complementary receptors inside the cap component.

While the invention may exhibit any number of lugs it is preferred that three such lugs be provided on each base component in a triangulated arrangement.

It is further preferred that the dimensions of the lugs and receptors be such that the nozzle system can only be assembled in one orientation.

It is further preferred that an O-ring be provided within the cap component to provide compression between the base and cap causing the nozzle system to lock when the cap is twisted onto the base by hand.

The multiple lug and receptacle combination may include a third lug and corresponding receptacle. The first, second and third lugs may be positioned in a triangulated arrangement and the first, second and third receptacles may be positioned in a corresponding triangulated arrangement. The lugs may be located on the base and said receptacles may be located in said cap, or vice versa, although the former is preferred.

The lugs may be bayonet type lugs that taper to a leading edge. Each of the bayonet type lugs may comprise an inclined ramp surface to facilitate axial compression of the cap relative to the base on engagement of the cap on the base as the cap is twisted relative to the base.

The nozzle assembly may further comprise a compressible seal that is partially compressed on engagement of the cap with the base. The assembly may be locked by the resulting compressive forces between the lugs and the corresponding receptors.

The lugs may be set at an angle of about 120° with respect to one another and relative to the axis of the central aperture.

The first lug may be longer than the second lug and the first receptacle may be longer than the second receptacle, so that the second receptacle cannot receive the first lug and the cap must be rotated until the first lug engages with the first receptacle to achieve the required orientation.

The nozzle disc may comprise a disc base having at least one locating structure adapted to cooperate with a key on or in the seat of the cap or the base to limit the possible orientation of the nozzle disc relative to the cap and the base. The locating structure may comprise one or more recesses formed in the disc base and the key may comprise one or more complementary shaped tabs. The key may be formed in a seat provided in the cap for the nozzle disc.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals and symbols denote similar features throughout the several views.

DETAILED DESCRIPTION OF THE DRAWING FIGURES AND PREFERRED EMBODIMENTS

Figure 1:
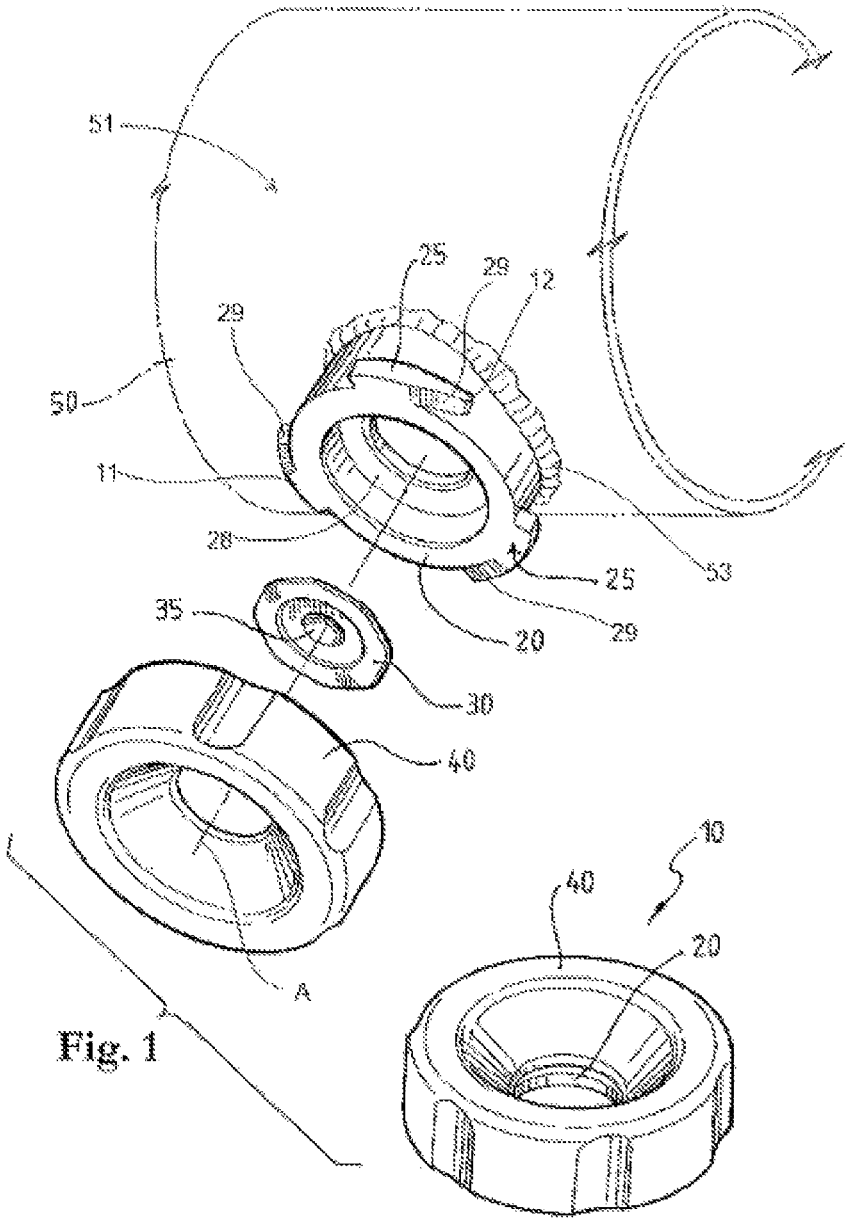
FIG. 1 shows an exploded diagram of the components of the nozzle system from the cap end of the nozzle.
Figure 2:
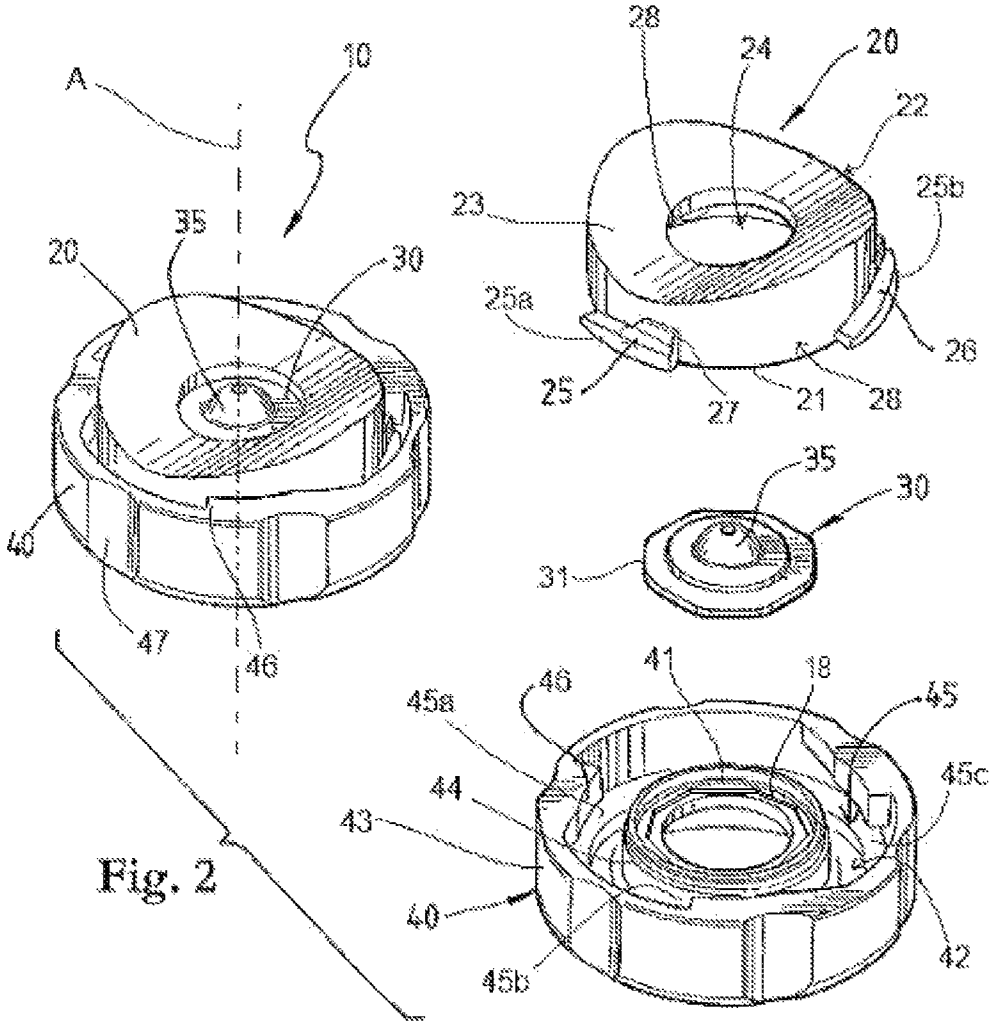
FIG. 2 shows an exploded diagram of the components of the nozzle system from the perspective of the base component.
Figure 3:
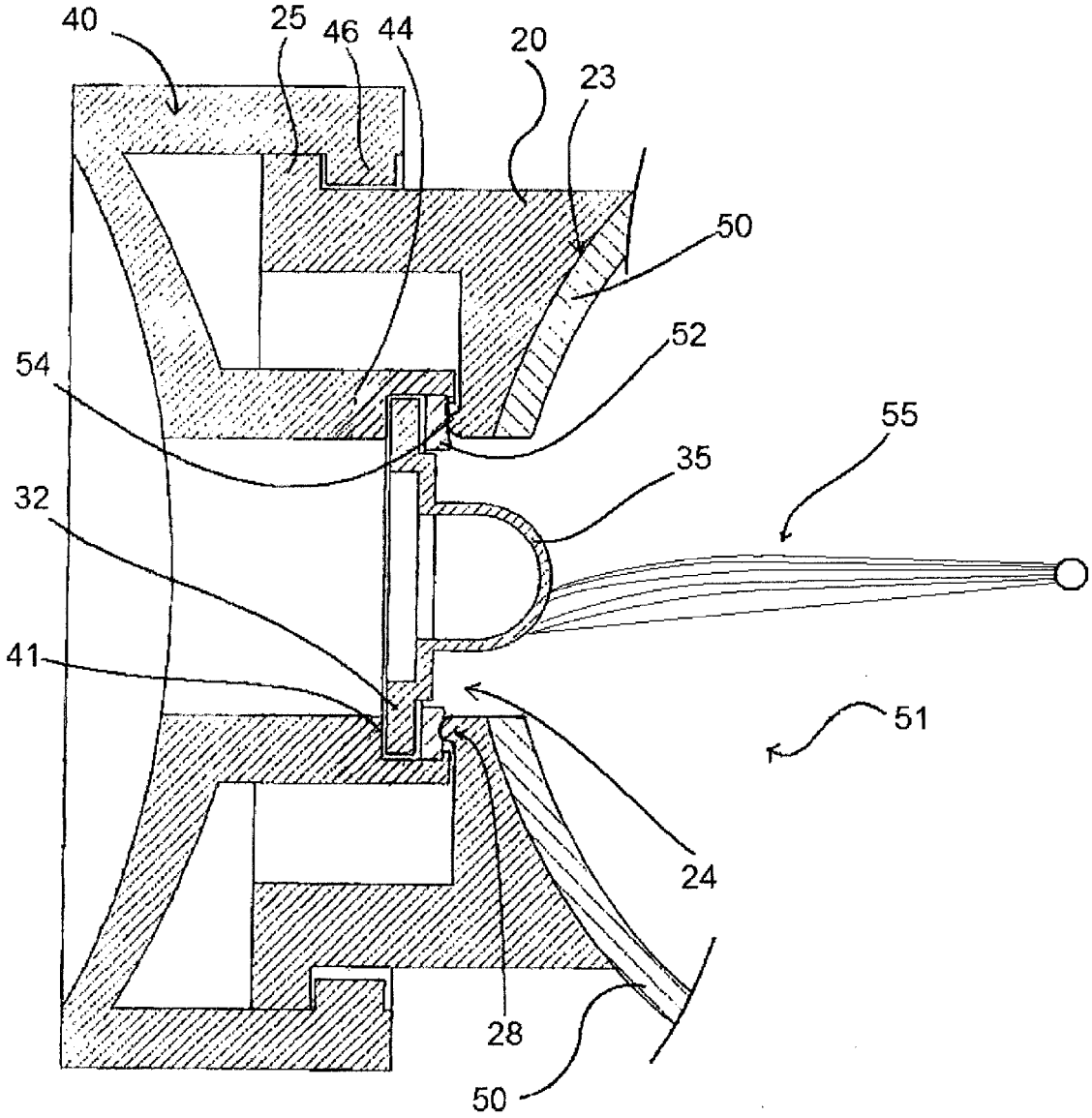
FIG. 3 shows a cross-sectional view of the cap and base with the nipple of the shower disc extending into the spray pipe; and, FIG. 4 shows an exploded view of the components of the nozzle system according to a different embodiment in which the nozzle disc is keyed from the perspective of the base component

In a preferred embodiment of the invention shown in FIGS. 1-3, a nozzle assembly 10 utilizes a pressed disc shaped nozzle 30 with a convex nipple 35 which contains an orifice, and which protrudes up into and past the internal diameter of the spray pipe 50 to which it is mounted.

The nozzle disc 30 is generally octagonal in plan. The generally flat sides of the nozzle disc 30 may be uniformly shaped and dimensioned. Alternatively, to permit only limited orientation of the nozzle disc 30 in a cap 40, the flat sides may be different lengths, so that there is less than eight possible orientations and preferably only two. The nozzle disc 30 is therefore received in a seat 41 formed for this purpose in the cap 40 preferably in a specific orientation. Although the seat 41 is shown as a generally octagonal seat in FIG. 2, the skilled reader will appreciate that the seat 41 may be an irregular generally octagonal shape corresponding to the shape of the nozzle disc 30 having flat sides 18 angled at about 45° relative to each adjacent flat side wall 18, whereby some of the flat side walls 18 are longer than the other flat side walls 18 to insure that the nozzle disc 30 can only be seated in a particular orientation, or only one of two bi-laterally symmetrical orientations. The seat's 41 flat internally facing walls 18 generally complement, and correspond to, the flat walls 31 of the nozzle disc 30. The nipple 35 is required to be inserted facing upwardly into the spray pipe 50.

In the preferred form of the invention shown in the drawings, the nozzle disc 30 is mounted to the spray pipe 50 between a base 20 and the cap 40. As shown in the embodiment in FIG. 1, the base 20 and the cap 40 can be attached to each other manually by bayonet type fittings 29 in the form of triangulated male lugs 25 on the base 20 which cooperate with recess receptors 45 in the cap 40.

The base comprises a generally cylindrical body with a generally cylindrical wall 28. The lower edge 21 of the cylindrical wall 28 is generally flat and adapted to be received in a corresponding annular channel 42 formed between an outer generally cylindrical wall 43 and an inner cylindrical wall 44 of the cap 40. Within the annular channel 42, the cap 40 includes three corresponding inwardly radial protrusions 46 that extend partway circumferentially around the inner edge of the channel 42 and, together with the inner and outer cylindrical walls 43, 44 and the radial protrusions 46, define three recess receptors 45*a-c*.

The base cylindrical wall 28 has an upper curved edge 22 that transitions to a curved broad faced surface 23 that is adapted to correspond to the radius of the spray pipe 50. The curved upper base surface defines a large central aperture 24 that permits the nipple 35 to extend through into the spray pipe space 51 where it may be exposed to a rotating brush 55 for cleaning.

Each of the recess receptors 45*a-c* is differentially shaped, so that only the one of the corresponding lugs 25*a-c* may fit one of the recess receptors 45*a-c*. In FIG. 2, the length of the ramp 26 of the lug 25*b* is longer than the corresponding ramp of lug 25*a*. Therefore, the lug 45*a* may only fit in the receptor 45*a*, the lug 45*b* may only fit in the receptor 45*b*, and so on. Therefore the cap 40, and hence the shower nipple 30, can be mounted onto the base 20 in one orientation only. The lugs 25 have a front surface 11 that faces outwardly from the base 20 when mounted on the pipe 50. The front surface 11 and the ramp 26 together define the bayonet type fitting 29 as they taper from a broad structure of the main body of each lug 25, down to a pointed leading bayonet end 12.

The triangulated lugs 25*a-c* comprise a ramp 26 and a detent or terminal frictional locking structure 27 that assists to lock the cap 40 and base 20 in engagement by being received in a corresponding slot (not shown) formed in the recess receptacles 45*a-c*. In any case, the combination of the engagement means 25, 45 and a compressible O-ring seal 52 assist to provide a locking engagement of the cap 40 and the base 20 as will be further described below.

The base component 20 may be welded by weld 53 to the header spray pipe 50. However, alternative means of attachment may include cable ties and spring clips and the like, as any appropriate attachment means may be used.

The O-ring is provided between the disc member 30 and base component 20 in order to provide a sealing means. A further O-ring is provided in an internal periphery of the cap 40 so that when the nozzle assembly 10 is connected, the further O-ring is partially compressed and the system is locked by the resulting compressive forces between the lugs 25 and the receptors 45. In this regard the ramp 26 is inclined relative to a plane extending normal to a longitudinal axis A of the nozzle assembly 10. As the cap 40 is rotatably engaged onto the base 20, the ramp 26 rides against the opposed surface of the protrusion 46 and applies axial force against the periphery of the nozzle disc 30 and the O-rings to achieve a locked engagement as further described with reference to FIG. 3 below.

It is thus a simple matter to assemble and disassemble these components without tools by merely twisting the cap 40 relative to the base 20. The cap 40 therefore has axially aligned finger grooves or surface features 47 on its external wall 43 to permit manual gripping by an operator.

Both the base 20 and the cap 20 are provided with apertures 24 therethrough and the base 20 is provided with a centrally oriented seat 28 into which the periphery of the shower nozzle disc 30 may be seated. The nozzle disc 30 is therefore installed when the cap 40 is twisted down onto the base 20. The seat 28 is shown as an annular structure and in practice, as described below with reference to FIG. 3, has an annular, generally axially directed lip 54 that axially bears against the seal 52, 52*a*.

This arrangement obviates the need for tools and also reduces the possibility of any machine or external vibration causing the cap 40 to disengage.

As discussed, the lugs 25 and receptors 45 are dimensioned such that the system can be connected in one orientation only which prevents the nozzle disc 30 from spraying in a wrong plane by being mistakenly installed in the incorrect orientation.

The invention provides a smooth external design which impedes the build up of debris and the like. In addition the wide open interior design allows wider spray patterns to spray out of the fitting uninterrupted and the shallow profile gives good access to the pipe brush adapted to clean the nipple 35 area.

The nozzle assembly 10 of the invention allows for easy disassembly thereby reducing maintenance time significantly. Also the use of the three bayonet type engagement means replaces the need for screw threads which may otherwise become damaged as in other systems.

The invention provides a simple unitary assembled piece which in the nozzle assembly 10 which can be assembled with ease and without tools.

In the preferred embodiment of the invention three retaining clasps in the form of the lugs 25 and receptacles 45 are described in a triangulated arrangement for great symmetry, stability and strength of engagement. While such an arrangement is preferred, the invention is not restricted in this regard and more retaining clasps may be used, and two is achievable if the surface area of the engagement surfaces in sufficiently large. In addition, either male or female lugs 25 could be used on either the cap 40 or the base 20.

Referring to FIG. 3, the nozzle disc 30 with nipple 35 is retained in the cap 40 by the single rubber washer seal 52. The seal 52 is retained via a visible annular lip 54 formed about the inner edge of the curved surface 23 that defines the central aperture 24 and being a shallow radiused spigot protruding from the base 20. The seal 52, when compressed by the engagement of the base 20 and cap 40 of the nozzle assembly 10, forms a seal between a periphery 32 of the nozzle disc 30 and the lip 54.

The seal 52 also provides the sprung preload upon which the cap 40 is maintained in the locked position. It may be released by pushing on the cap 40 towards the pipe 50 and against the spring action of seal 52, thereby overriding detent 27 so that the cap 40 may be rotated and released from the base 20.

The nipple 35 is dimensioned to extend beyond the line of the curve of the internal surface of the wall of the pipe 50 to make it accessible to the pipe brush. Furthermore, the aperture 24 defines an annular gap surrounding the nipple 35 that reduces the potential for debris collection around the nozzle 35. This is made possible by the flat structure of the periphery 32 of the nozzle disc 30, and the axially short space occupied by the seal 52 and the seat 28, coupled with the axially extending nozzle nipple 35 that sits just proud beyond the line of the curved pipe 50 wall surface. The short axial distance between the nipple 35 tip and the peripheral flange 32 of the nozzle disc 30 reduces the potential for collection of debris and facilitates cleaning by the pipe brush in the cavity surrounding the nipple 35.

Figure 4:
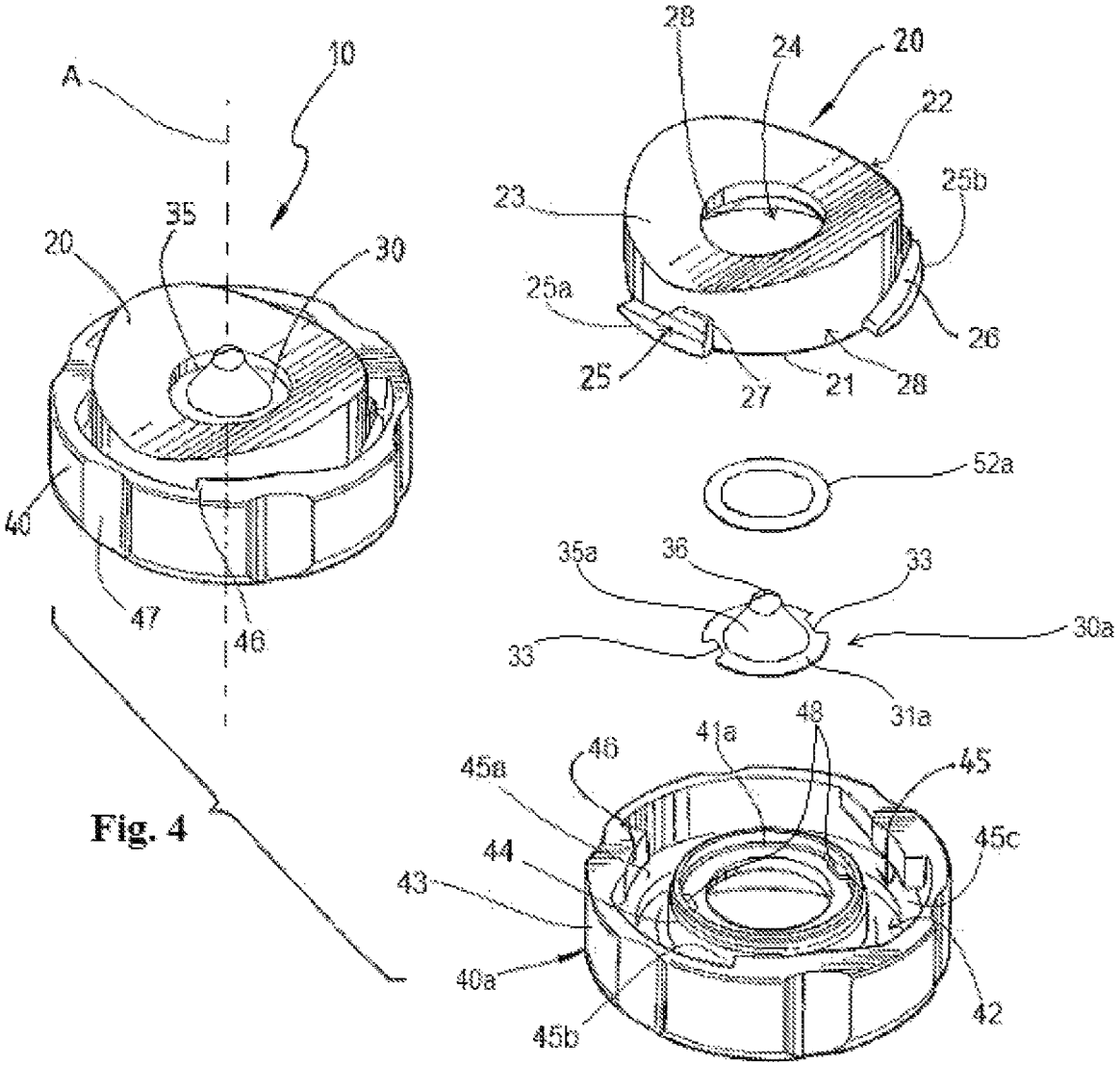

In FIG. 4, a modification of the embodiment shown in FIGS. 1-3 is shown in which a nozzle disc 30*a* comprises a large, dome-shaped nipple 35*a* continuous with, and extending out from, an oval shaped and generally planar disc base 31*a* comprising, at each end, a recess 33 in the form of a cut out, slot or notch. The nipple 35*a* is pronounced whereby to extend into the spray pipe cavity or space 51 beyond the line of the internal wall of the pipe 50 to facilitate brush access to the nipple 35*a* and the orifice 36 for effective cleaning. The nipple 35*a* presents a large and broad surface to the brush internally located in the pipe 50. The substantially conically shaped wall of the nipple 35*a* is inclined at an angle of about 35-55°, and preferably about 45-50°, from the disc base 31*a* up to the orifice 36 whereby the diameter of the base 37 of its conical wall is only marginally smaller than a large central aperture 24 formed in the base 20*a*. The marginal annular gap between the conical base wall 37 of the nipple 35*a* and the inner wall of the base 20*a* defining the aperture 24 is substantially filled by an annular seal 52*a*. In this way, there are minimal crevices or gaps in which sprayed material may collect about the nipple 35*a* and the nozzle disc 30*a*. This may improve the efficiency of the nipple's 35*a* operation as less debris will tend to collect in and around it and will reduce the need for cleaning of the nipple 35*a* by the abrasive bristles, thereby prolonging the life of the nipple 35*a* and hence the replaceable nozzle disc 30*a* through wear minimization.

The nozzle disc 30*a* may comprise one or more recesses 33 that, in cooperation with a corresponding and complementary shaped key 48 formed in a seat 41*a* of a cap 40*a*, facilitate a prescribed orientation of the nozzle disc 30*a* relative to the cap 40*a*. Each recess 33 shown in FIG. 4 is semicircular in shape, but it will be appreciated that the recess 33 cooperates with the key 48 and may be any suitable shape provided that it complements the key 48. As shown in FIG. 4, preferably the walls or edges of the disc base 31*a* are curved and the concave walls of the recess 33 are also curved inter alia for the purposes of strength and wear resistance.

The nipple 35*a* comprises an elongate or slit orifice 36 adapted to align in a specific direction to provide a reliable and predictable spray pattern with a particular orientation in the pipe 50. Accordingly, the orientation of the nozzle disc 30*a* itself in the seat 41*a*, and hence the alignment of the orifice 36 in the pipe 50, is controlled by the recess cooperating with the key 48.

The key 48 is formed in the seat 41*a*. The seat 41*a* comprises a generally oval shape adapted to receive, in seated fashion, the disc base 31*a*, which is clamped between the base 20 and the cap 40*a* with the interposed seal 52*a* in a manner similar to that shown in FIG. 3 in relation to the embodiment of FIGS. 1-3.

While only several embodiments of the present invention have been shown and described, it will be obvious to those skilled in the art that many modifications may be made to the present invention without departing from the spirit and scope thereof.

What is claimed is:

1. A nozzle assembly, comprising:

a base fixed to a spray pipe containing an internal brush system;

a cap engageable to said base in only one orientation by a multiple lug and receptacle combination, comprising at least two circumferentially spaced male or female lugs for engaging complementary receptors, said at least two spaced male or female lugs including at least a first lug and a second lug; and, a nozzle disc able to be held compressively between said base and said cap with a bore extending through said spray pipe, said base and said cap, and with said nozzle disc comprising a nipple extending into said spray pipe when said nozzle assembly is assembled, wherein said cap is manually engageable to said base by applying axial compression to said cap and twisting said cap relative to said base until said first lug and second lug are locked in engagement in a corresponding first receptacle and second receptacle in said one orientation.

2. The nozzle assembly according to claim 1, wherein said multiple lug and receptacle combination includes a third lug and corresponding receptacle.

3. The nozzle assembly according to claim 2, wherein said first lug, said second lug and said third lug are positioned in a triangulated arrangement and said first receptacle, said second receptacle and said third receptacle are positioned in a corresponding triangulated arrangement.

4. The nozzle assembly according to claim 1, wherein said first lug and said second lug are located on said base and said first receptacle and said second receptacle are located in said cap.

5. The nozzle assembly according to claim 4, wherein said first lug and said second lug are set at an angle of about 120° relative to one another and relative to an axis of said bore.

6. The nozzle assembly according to claim 1, wherein said first lug and said second lug are bayonet lugs tapered to a leading edge.

7. The nozzle assembly according to claim 6, wherein said bayonet lugs include an inclined ramp surface facilitating axial compression of said cap relative to said base upon engagement of said cap on said base as said cap is twisted relative to said base.

8. The nozzle assembly according to claim 1, further comprising a compressible seal that is partially compressed upon engagement of said cap with said base and said nozzle assembly is locked by resulting compressive forces between said first lug and said second lug and said complementary receptors.

9. The nozzle assembly according claim 1, wherein said first lug is longer than said second lug and said first receptacle is longer than said second receptacle, so that said second receptacle cannot receive said first lug and said cap must be rotated until said first lug engages with said first receptacle for achieving said one orientation.

10. The nozzle assembly according to claim 1, wherein said nozzle disc comprises a disc base having at least one locating structure for cooperating with a key located on, or in, a seat of the cap or the base for limiting a potential orientation of the nozzle disc relative to the cap and the base.

11. The nozzle assembly according to claim 10, wherein said locating structure comprises at least one recess formed in the disc base and the key comprises at least one complementary shaped tab.

12. The nozzle assembly according to claim 10, wherein said key is formed in a seat provided in the cap for the nozzle disc.

* * * * *